US012618633B2

(12) United States Patent
Wells

(10) Patent No.: US 12,618,633 B2
(45) Date of Patent: May 5, 2026

(54) GUN BARREL BRUSH

(71) Applicant: Roy Eugene Wells, Crestview, FL (US)

(72) Inventor: Roy Eugene Wells, Crestview, FL (US)

( * ) Notice: Subject to any disclaimer, the term of this patent is extended or adjusted under 35 U.S.C. 154(b) by 0 days.

(21) Appl. No.: 19/212,848

(22) Filed: May 20, 2025

(65) Prior Publication Data

US 2025/0362104 A1 Nov. 27, 2025

Related U.S. Application Data

(60) Provisional application No. 63/651,651, filed on May 24, 2024.

(51) Int. Cl.

| | |
|---|---|
| ***F41A 29/02*** | (2006.01) |
| ***A46B 5/02*** | (2006.01) |
| ***A46B 7/04*** | (2006.01) |
| ***A46B 9/02*** | (2006.01) |

(52) U.S. Cl.

CPC ..... *F41A 29/02* (2013.01); *A46B 5/026* (2013.01); *A46B 7/04* (2013.01); *A46B 9/026* (2013.01); *A46B 2200/3013* (2013.01)

(58) Field of Classification Search

CPC ..... F41A 29/00; F41A 29/02

See application file for complete search history.

(56) References Cited

U.S. PATENT DOCUMENTS

| | | | |
|---|---|---|---|
| 4,499,625 | A | 2/1985 | Bottomley |
| 5,204,483 | A | 4/1993 | Tellechea |
| 5,657,570 | A | 8/1997 | Emmanuel |
| 5,809,601 | A | 9/1998 | Rivera |
| 5,934,000 | A | 8/1999 | Hayes, Sr. |
| 6,701,658 | B1 | 3/2004 | Brownell |
| 7,520,082 | B2 | 4/2009 | An |
| 7,836,624 | B1 | 11/2010 | Pennington |
| 11,761,726 | B1 | 9/2023 | Duquette |
| 11,890,653 | B2 | 2/2024 | Ellis, III |
| 2006/0277811 | A1 | 12/2006 | Peterson |
| 2011/0047852 | A1 | 3/2011 | Loftin |
| 2012/0186128 | A1 | 7/2012 | Williams et al. |
| 2014/0338701 | A1 | 11/2014 | Freytag |
| 2015/0362279 | A1 | 12/2015 | Kim |
| 2021/0309944 | A1 | 10/2021 | Brooker et al. |
| 2023/0288166 | A1 | 9/2023 | Hoodecheck et al. |

*Primary Examiner* — Reginald S Tillman, Jr.

(74) *Attorney, Agent, or Firm* — Dunlap Bennett & Ludwig PLLC

(57) ABSTRACT

A cleaning tool for ported firearm barrels with integrated suppressors is disclosed. The tool comprises a cylindrical brush housing with an inner cavity to accommodate a barrel brush insert featuring radially extending bristles for removing carbon deposits and debris. A retaining washer and clip secure the brush insert within the housing. The assembly includes a cylindrical handle with internal threading to engage the housing's threaded neck, and an externally knurled surface for improved grip. The brush insert is interchangeable, allowing various cleaning media such as stainless steel, alloy steel, Aluminum, Bronze, Nylon, Brass, Plastic, Polypropylene, rubber, or other metals. The design eliminates the need for firearm disassembly and avoids reliance on the suppressor as a cleaning component, enhancing user safety and preserving firearm integrity. This tool facilitates efficient maintenance of firearms with integrally suppressed systems, promoting reliability and extending the lifespan of the firearm.

6 Claims, 4 Drawing Sheets

GUN BARREL BRUSH

CROSS-REFERENCE TO RELATED APPLICATIONS

This application claims benefit to Provisional Application No. 63/651,651 filed May 24, 2024, the contents of which are herein incorporated by reference.

BACKGROUND OF THE INVENTION

The present disclosure pertains to mechanical cleaning tools, specifically to brushes designed for cleaning ported gun barrels on firearms with integrated suppression systems.

The field of firearm maintenance often involves the use of specialized cleaning tools designed to address the challenges presented by modern firearms. Many cleaning devices have been developed to remove carbon deposits and general grime from gun barrels, an important step in promoting reliable firearm operation. These tools typically focus on cleaning the interior surfaces or make use of components that are part of the firearm's integrated systems, such as the suppressor. In this context, maintaining performance while reducing the complexity of the cleaning process is a continual objective for manufacturers and users alike. However, the specific construction of some firearms creates challenges that conventional cleaning tools have yet to fully address.

In many applications, there is a desire for cleaning devices that facilitate routine maintenance without necessitating extensive disassembly of the firearm. Users benefit from solutions that streamline the cleaning process while still effectively removing residues that can impair performance. The applicative goal is to create a tool that allows thorough cleaning of difficult-to-access areas while preserving the integrity of delicate components, such as the suppressor. Improved cleaning efficiency can contribute to both the longevity of the device and the safety of the operator, especially in scenarios where traditional methods may prove cumbersome or unsafe.

Generally, challenges in the cleaning process arise when conventional tools require the user to either access internal surfaces through complete disassembly or depend on components that may be sensitive to misuse. Some designs require users to interact with parts of the firearm that may be adversely affected by high temperatures or repetitive handling, such as the suppressor, thereby increasing the risk of inadvertent damage. The complexity of cleaning assemblies can also discourage regular maintenance, potentially leading to performance issues or premature wear. Without a user-friendly tool, the routine upkeep of such firearms becomes both time consuming and labor intensive.

Specifically, difficulties emerge when the cleaning process involves contact with areas that are exposed to excessive heat or that possess vulnerable surfaces. In certain cases, tools on the market have required the application of cleaning forces through mechanisms that are not optimally designed for this purpose, risking harm to sensitive components. Such approaches may inadvertently compromise the durability of the firearm and elevate safety concerns for the operator.

There is a clear need for a cleaning solution that minimizes these risks while enabling effective removal of contaminants from challenging areas without resorting to full disassembly or using components in unintended ways.

SUMMARY OF THE INVENTION

In one embodiment, the disclosure provides a barrel brush assembly that includes a substantially cylindrical brush housing defining an inner cavity configured to receive a firearm barrel and featuring a threaded neck at one end. The assembly further comprises a removable barrel brush element having a body from which a plurality of bristles extend radially inward and which is formed of a first cleaning medium. A retaining washer is removably positioned within the cavity in contact with the barrel brush element, and a retaining clip is also removably disposed in the cavity to secure both the barrel brush element and the retaining washer in place. Additionally, the assembly includes a substantially cylindrical handle having an inner diameter configured to receive the firearm barrel and an internal threaded surface arranged to engage the threaded neck of the brush housing.

In another embodiment, the barrel brush assembly incorporates an additional interchangeable barrel brush element having a body with a plurality of bristles that extend radially inward, the bristles being formed of a second cleaning medium, and configured to replace the primary barrel brush element within the cavity. In some embodiments, the first cleaning medium is selected from the group consisting of steel, aluminum, bronze, brass, plastic, nylon, polypropylene, or rubber, and the second cleaning medium may be similarly selected. Other embodiments include features in which the outer surface of the barrel brush element's body exhibits a first knurling, and the outer surface of the handle exhibits a second knurling.

DETAILED DESCRIPTION OF THE INVENTION

Figure 1:
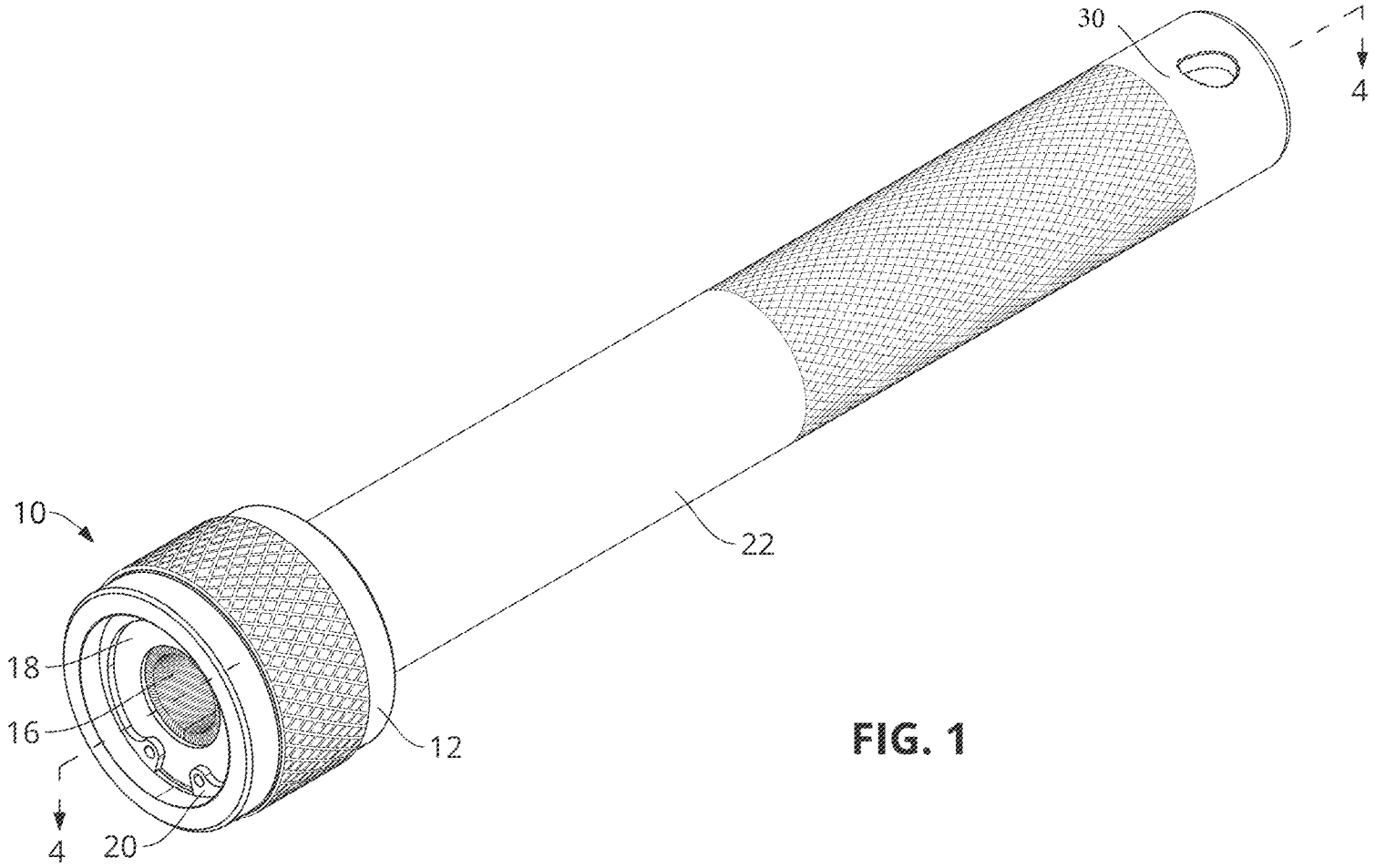
FIG. 1 is a perspective view illustrating the brush assembly configured for cleaning ported gun barrels on firearms with integrated suppression systems.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The maintenance and cleaning of firearms, particularly those with ported barrels that include integrally suppressed systems, present significant challenges due to the complex design and configuration of such firearms. Firearms with integrally suppressed systems incorporate a hand guard or shroud mechanism that surrounds the barrel, making access to the barrel for cleaning purposes more difficult. Over time, carbon deposits, soot, and other debris accumulate on the barrel and within the ports, potentially impairing the firearm's performance and reliability. Regular cleaning is important to maintain proper functionality and to reduce the risk of premature wear or catastrophic failure. However, the intricate design of firearms with integrally suppressed systems often requires partial or full disassembly to access the barrel, which can be time-consuming and inconvenient for users.

Existing cleaning tools in previous designs have attempted to address these challenges but exhibit significant limitations. For example, some tools require the use of the suppressor itself as a handle or cleaning component. This approach can be problematic, as suppressors are often hot after use, posing a risk of burns to the user. Additionally, using the suppressor as a cleaning tool may lead to damage or wear on this expensive and sensitive component. Other tools in the market are not user-serviceable, meaning that once the cleaning elements, such as brushes, wear out, the entire tool needs to be replaced. Furthermore, many existing tools are not designed to accommodate different cleaning media, such as brushes made of metal, brass, or plastic, limiting their versatility and effectiveness. These shortcomings discourage regular maintenance and may lead to neglect, which compromises the firearm's performance and safety.

The present disclosure provides a novel and improved solution to these challenges by offering a cleaning tool specifically designed for firearms that are integrally suppressed. This cleaning tool eliminates the need for full disassembly of the firearm and does not rely on the suppressor as a cleaning component, thereby reducing the risk of damage to the suppressor and enhancing user safety. The cleaning tool is user-serviceable, allowing for the replacement of worn brushes and the use of interchangeable cleaning media to accommodate various cleaning needs. Additionally, the tool incorporates a handle designed to facilitate ease of use and ensure that the cleaning process is both efficient and effective. By addressing the limitations of existing solutions, the present disclosure promotes regular maintenance, extends the lifespan of the firearm, and enhances overall reliability and safety.

Figure 3:
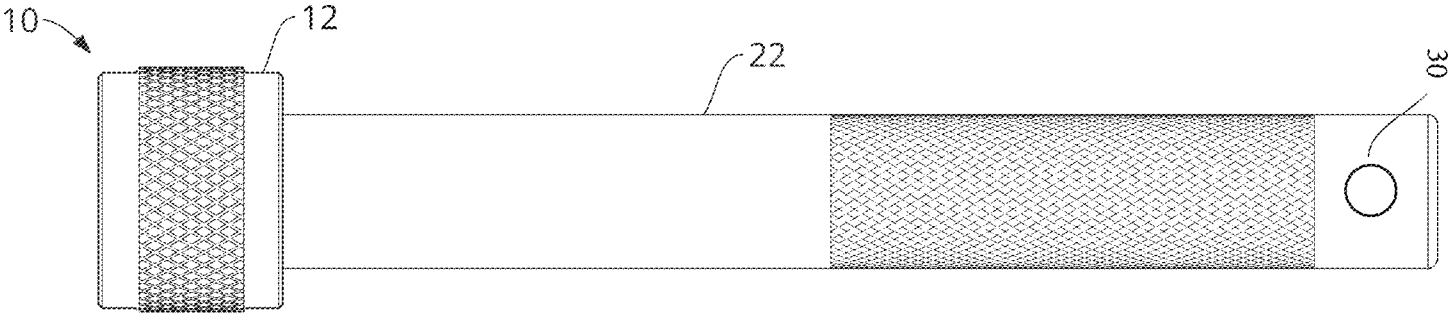
FIG. 3 is a side view illustrating the assembled brush assembly configured for cleaning ported gun barrels.

FIG. 1 and FIG. 3 show a brush assembly 10 configured for cleaning ported gun barrels on firearms with integrated suppression systems. The brush assembly 10 is composed of several interconnected components, including a brush housing 12, a brush bristle assembly 16, a washer 18, a retainer clip 20, and a brush handle 22, that work together to facilitate efficient cleaning while ensuring user safety and preserving the integrity of the firearm.

Brush housing 12 is a substantially cylindrical structure that forms the main body of brush assembly 10. Brush housing 12 is designed to house brush bristle assembly 16, which is positioned within the cavity of brush housing 12. Brush housing 12 features an inner surface that defines the cavity, providing sufficient space to accommodate brush bristle assembly 16 during cleaning operations. The outer surface of the brush housing 12 may include knurling to enhance grip and ease of handling during use, particularly in scenarios where precision and control are required, but is not so limited.

Brush bristle assembly 16 is located within the cavity of brush housing 12 and includes a plurality of radially extending bristles. These bristles are designed to engage firearm barrel 28 and effectively remove carbon deposits, soot, and other debris that accumulate during firearm operation. Brush bristle assembly 16 is interchangeable, allowing users to select different cleaning media, such as stainless steel, alloy steel, Aluminum, Bronze, Nylon, Brass, Plastic, Polypropylene, rubber, metals, etc., depending on the specific cleaning requirements and the sensitivity of the firearm components.

Washer 18 is positioned adjacent to brush bristle assembly 16 within the cavity of brush housing 12. Washer 18 serves as a protective barrier, preventing direct contact between brush bristle assembly 16 and other components of brush housing 12. This design feature helps to preserve the structural integrity of brush assembly 10 and ensures consistent cleaning performance over time.

Retainer clip 20 is inserted into brush housing 12 to secure brush bristle assembly 16 and washer 18 in place. Retainer clip 20 is configured to fit into a groove within brush housing 12, providing a reliable locking mechanism that prevents the components from shifting or becoming dislodged during use. This arrangement ensures that brush assembly 10 remains functional and stable throughout the cleaning process.

Brush handle 22 is attached to brush housing 12 and extends outward to provide a convenient gripping surface for the user. Brush handle 22 is substantially cylindrical and may include an externally knurled surface to facilitate secure grasping, even in conditions where the user's hands may be wet or oily. Brush handle 22 is designed to mate with brush housing 12 via threading, creating a robust and user-friendly assembly. This integrated handle eliminates the need to use the suppressor as a cleaning component, thereby reducing the risk of burns and damage to the suppressor. The combination of these components in brush assembly 10 provides a novel solution for cleaning ported gun barrels on firearms with integrally suppressed systems. The design reduces the need for firearm disassembly, improves user safety, and encourages consistent maintenance by offering a flexible and effective cleaning tool utilizing the brush housing 12, brush bristle assembly 16, washer 18, retainer clip 20, and brush handle 22.

Figure 2:
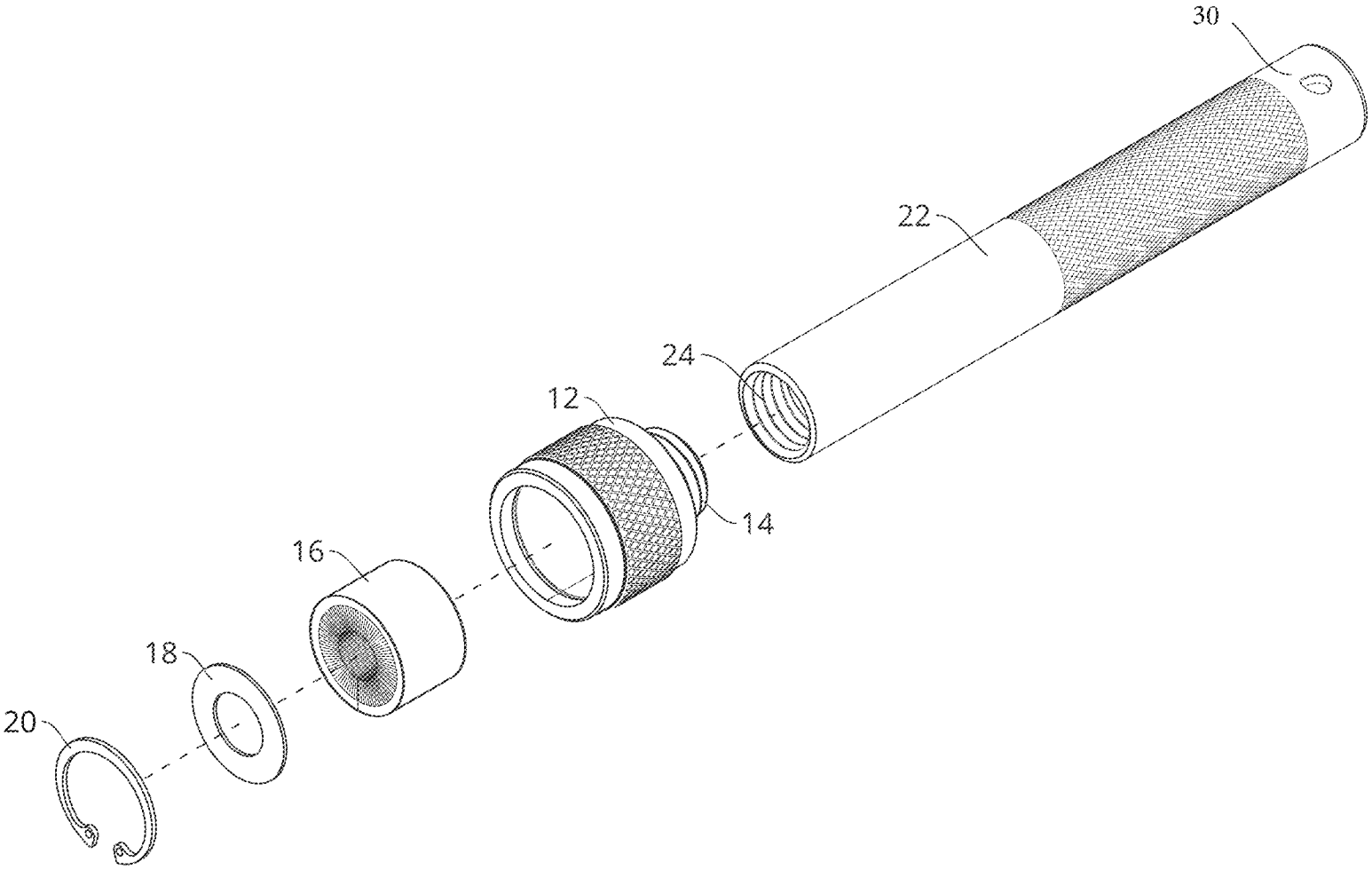
FIG. 2 is an exploded view illustrating the assembly of the brush housing, handle, and associated components of the gun barrel brush.

FIG. 2 shows an exploded view of brush assembly 10, illustrating the individual components and their arrangement within the assembly. This figure provides a detailed depiction of how the components interact and fit together to form the complete cleaning tool, including brush housing 12, male threading 14, brush bristle assembly 16, washer 18, retainer clip 20, brush handle 22, and handle threads 24. Brush housing 12 is a generally cylindrical structure that serves as the main body of the brush assembly 10. The design includes an inner cavity configured to hold brush bristle assembly 16, washer 18, and retainer clip 20. One end of brush housing 12 incorporates male threading 14, which allows for the attachment of brush handle 22. The outer surface of brush housing 12 may include knurling to improve grip and simplify handling during use.

Figure 5:
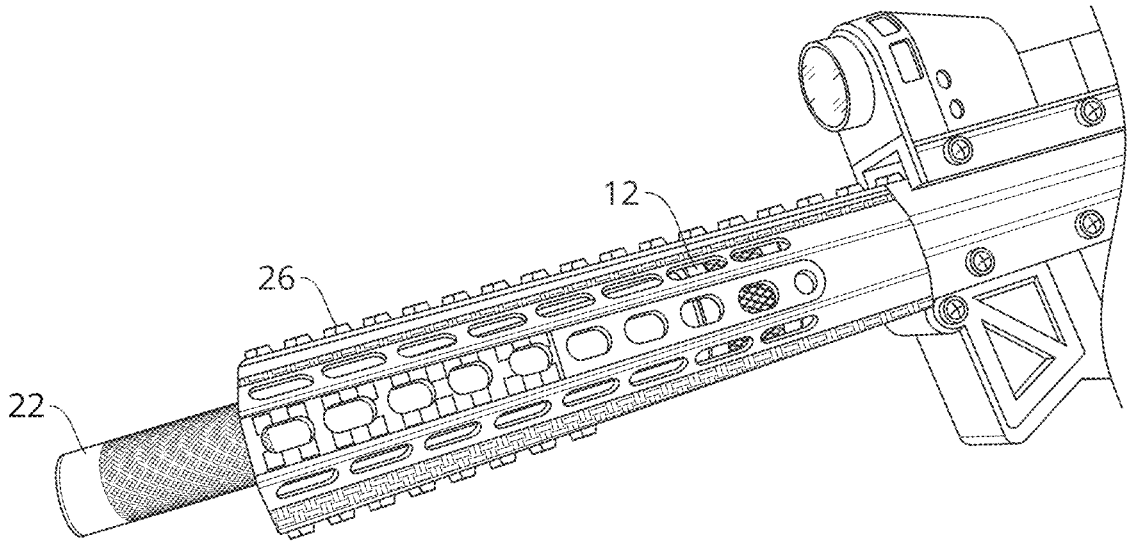
FIG. 5 illustrates a perspective view of the brush assembly in use on a firearm barrel with the handguard removed.
Figure 6:
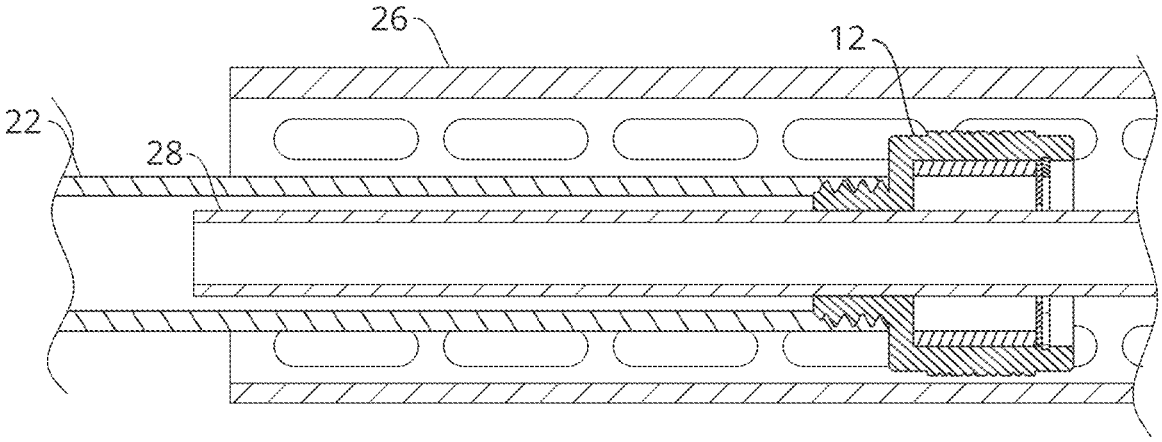
FIG. 6 is a cross-sectional view illustrating the brush assembly in use on a firearm barrel within the handguard.

Brush bristle assembly 16 is positioned within the cavity of brush housing 12. The assembly includes a substantially cylindrical body with a plurality of bristles extending radially therefrom to engage the firearm barrel 28 and facilitate the removal of carbon deposits, soot, and other debris, as illustrated in FIG. 5-6. The bristles are affixed to the inner wall of a substantially cylindrical body, which enables them to extend inward toward the barrel during cleaning operations, as illustrated in FIG. 5-6. Brush bristle assembly 16 is interchangeable, allowing users to select various cleaning media, such as stainless steel, alloy steel, Aluminum, Bronze, Nylon, Brass, Plastic, Polypropylene, rubber, metals, etc., depending on the particular cleaning requirements and the sensitivity of the firearm components.

Washer 18 is located adjacent to brush bristle assembly 16 within the cavity of brush housing 12. The washer functions as a protective barrier, preventing direct contact between brush bristle assembly 16 and other components of brush housing 12. This design feature helps preserve the structural integrity of the brush assembly and promotes reliable cleaning performance over time.

Retainer clip 20 is inserted into brush housing 12 to secure brush bristle assembly 16 and washer 18 in place. The retainer clip 20 is configured to fit into a groove within brush housing 12, providing a reliable locking mechanism that prevents the components from shifting or becoming dislodged during use. This arrangement ensures that the brush assembly remains functional and stable throughout the cleaning process.

Figure 4:
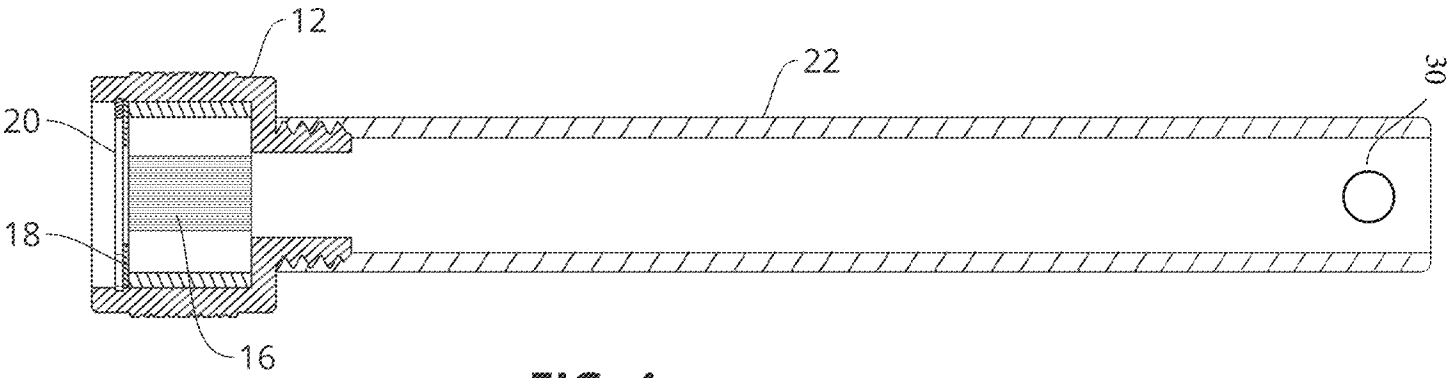
FIG. 4 is a cross-sectional diagram illustrating the assembly of the brush housing and handle in the gun barrel cleaning tool.

Brush handle 22 is a substantially cylindrical component that extends outward from brush housing 12 to provide a convenient gripping surface for the user. Brush handle 22 includes handle threads 24, which can be female threads, along the inner surface, which are configured to engage male threading 14 on brush housing 12, as illustrated in FIG. 4. This threaded connection creates a robust and user-friendly assembly. The outer surface of brush handle 22 may also include knurling to facilitate secure grasping, even in conditions where the user's hands may be wet or oily.

The exploded view in FIG. 2 highlights the modular nature of brush assembly 10, emphasizing the ease with which components can be assembled, disassembled, and replaced. This design allows for user-serviceability and adaptability, ensuring that the tool can accommodate various cleaning needs while maintaining effectiveness and durability. The components include brush housing 12, male threading 14, brush bristle assembly 16, washer 18, retainer clip 20, brush handle 22, and handle threads 24.

FIG. 5 shows the brush assembly 10 in use for cleaning firearm barrel 28, with the firearm handguard 26 removed to provide a clear view of the cleaning operation. The figure illustrates the interaction between the brush housing 12, the brush handle 22, and the firearm barrel 28, highlighting the tool's functionality and ergonomic design. The brush housing 12 is depicted as a substantially cylindrical structure that encapsulates the firearm barrel (not visible in this figure but described as component 28 in other sections and shown in FIG. 6) during the cleaning process. The housing is designed to accommodate the brush bristle assembly (not visible in this figure but described in other sections), which engages the barrel's surface to remove carbon deposits, soot, and other debris. The brush housing 12 ensures that the cleaning process is confined to the barrel, preventing debris from spreading to other firearm components and maintaining the integrity of the cleaning operation.

The brush handle 22 extends outward from the brush housing 12, providing a secure and ergonomic gripping surface for the user. The handle is shown with an externally knurled surface, which enhances grip and control during the cleaning process, even in conditions where the user's hands may be wet or oily. The handle's cylindrical design and the connection of the handle to the brush housing 12 via threading ensure a robust and user-friendly assembly. This configuration eliminates the need to use the suppressor as a cleaning component, thereby reducing the risk of burns and damage to the suppressor.

The firearm handguard 26, which is typically a protective and structural component surrounding the barrel 28, is shown removed in this figure to expose the advantages of brush assembly 10 in cleaning barrels that are difficult to access and demonstrate the cleaning tool's operation. The presence of the handguard 26 emphasizes the tool's ability to access and clean the barrel 28 effectively without requiring full disassembly of the firearm. This feature is particularly advantageous for firearms with integrated suppression systems, where traditional cleaning methods may be cumbersome or impractical.

The figure underscores the alignment of the brush housing 12 and the brush handle 22 with the firearm handguard 26, showcasing the tool's precision and ease of use. The design facilitates thorough cleaning of the barrel's surface, including hard-to-reach areas, while preserving the firearm's structural integrity and ensuring user safety.

It should be understood, of course, that the foregoing relates to exemplary embodiments of the invention and that modifications may be made without departing from the spirit and scope of the invention as set forth in the following claims.

What is claimed is:

1. A barrel brush assembly, comprising:

a substantially cylindrical brush housing having an inner surface defining a cavity configured to receive a firearm barrel and a threaded neck at a first end;

at least one barrel brush assembly having a body and a plurality of bristles extending radially inward from the body the plurality of bristles formed of a first cleaning medium, wherein the barrel brush assembly is removably disposed in the cavity;

a retaining washer removably disposed within the cavity in contact with the barrel brush assembly;

a retaining clip removably disposed in the cavity and configured to secure the barrel brush assembly and the retaining washer in place within the cavity;

a substantially cylindrical handle having an inner diameter and an internal threaded surface configured to engage the threaded neck of the brush housing, the inner diameter configured to receive the firearm barrel.

2. The barrel brush assembly of claim 1, at least one additional barrel brush assembly having a body and a plurality of bristles extending radially inward from the body, the plurality of bristles formed from a second cleaning medium, wherein the at least one additional barrel brush assembly replaces the at least one barrel brush assembly in the cavity.

3. The barrel brush assembly of claim 2, wherein the first cleaning medium is at least one of: Steel, Aluminum, Bronze, Brass, Plastic, Nylon, Polypropylene, or Rubber.

4. The barrel brush assembly of claim 2, wherein the second cleaning medium is at least one of: Steel, Aluminum, Bronze, Brass, Plastic, Nylon, Polypropylene, or Rubber.

5. The barrel brush assembly of claim 1, wherein an outer surface of the body of the barrel brush assembly has a first knurling thereon.

6. The barrel brush assembly of claim 1, wherein an outer surface of the substantially cylindrical handle has a second knurling thereon.

* * * * *